United States Patent [19]

Wood et al.

[11] 4,416,560

[45] Nov. 22, 1983

[54] COMPUTER PRINTER CARRIAGE CONTROL APPARATUS INCLUDING AN ENCODING DISK

[75] Inventors: Douglas E. Wood, Benton Harbor; Wayne J. Kooy, Galien; Lawrence C. Unger, Benton Harbor, all of Mich.

[73] Assignee: Printek, Inc., Benton Harbor, Mich.

[21] Appl. No.: 311,946

[22] Filed: Oct. 16, 1981

[51] Int. Cl.[3] ..... B41J 29/42

[52] U.S. Cl. ..... 400/705.1; 400/196.1; 400/229; 400/320

[58] Field of Search ..... 400/154.4, 162.3, 195, 400/196.1, 229, 320, 705.1

[56] References Cited

U.S. PATENT DOCUMENTS

| | | | |
|---|---|---|---|
| 3,858,702 | 1/1975 | Azuma | 400/320 |
| 4,180,334 | 12/1979 | Watanabe et al. | 400/320 X |
| 4,185,930 | 1/1980 | Umeda et al. | 400/320 |
| 4,195,938 | 4/1980 | Velazquez | 400/320 X |
| 4,203,679 | 5/1980 | Duerr et al. | 400/320 |
| 4,232,976 | 11/1980 | Bernardis et al. | 400/195 X |
| 4,300,847 | 11/1981 | Hoffman et al. | 400/229 X |

OTHER PUBLICATIONS

IBM Technical Disclosure Bulletin, "Printer Transport Motion Impedance Protection", Rigotti et al., vol. 22, No. 6, Nov. 1979, pp. 2433–2435.

*Primary Examiner*—Ernest T. Wright, Jr.

*Attorney, Agent, or Firm*—Leydig, Voit, Osann, Mayer & Holt, Ltd.

[57] ABSTRACT

There is disclosed a carriage control apparatus for a serial, impact computer printer. The carriage control apparatus comprises an encoder disk mounted for rotation on the carriage and having a coded pattern on its periphery, a photo sensor (and associated light source) for detecting the coded pattern and a drive means, preferably a serpentine toothed belt attached at each end to the printer's side frames that engages a sprocket wheel attached to the encoder disk to rotate the encoder disk in a fixed relationship to the carriage's position along the line of print of the printer.

8 Claims, 5 Drawing Figures

COMPUTER PRINTER CARRIAGE CONTROL APPARATUS INCLUDING AN ENCODING DISK

BACKGROUND OF THE INVENTION

The present invention relates to computer printers and particularly to a printer carriage control apparatus for horizontally positioning the printer carriage and print head during a printing operation. In computer printers, characters are formed on paper by the print head which is mounted on the carriage. The carriage travels horizontally back and forth across the face of the paper. In order to provide the proper horizontal spacing between and/or within characters during printing, it is necessary to position accurately the printer carriage along its horizontal path of travel.

Accurate horizontal positioning of the carriage and print head is important to provide an aesthetically pleasing printed page. Moreover, accurate positioning is especially important where the printer is used to fill in the "blanks" on pre-printed forms. Inaccurate horizontal positioning of the print head can cause the print characters to miss the "blank" space on pre-printed forms thereby producing overstriking of the pre-printed material and a generally unacceptable printing face.

Computer printers, that have been known and used in the past, have relied on several schemes for providing horizontal positioning of the printer carriage and print head. One scheme is the so-called "picket fence" arrangement. An encoding strip of alternate, evenly spaced dark and light bars is affixed to the frame of the printer and extends parallel to the horizontal path of travel of the printer carriage. The alternate dark and light bars of the encoder strip have the appearance of a picket fence and thus the terminology to describe such an arrangement. The printer carriage, in the picket fence arrangement, carries with it a light source and photosensor which is alternately activated and deactivated by light reflected from or transmitted through the light and dark horizontal bars of the "picket fence" as the printer carriage travels back and forth across the face of the paper. By counting the number of bars, the picket fence arrangement can establish through its logic control circuitry its position along its horizontal path of travel and, therefore, provide the requisite horizontal positioning of the printer carriage.

The picket fence provides an accurate system for horizontal positioning of the print head, but it is susceptible to drawbacks. Because the picket fence extends across the entire width of the computer frame, it is necessarily in the open, near where the paper is being fed into the printer and where impact printing is actually being accomplished. The loose paper fibers and other dirt that result from the print head impact and the feeding of paper at high speed can settle onto the picket fence and mask its alternate dark and light alternating bars. As a result, the photosensor in the carriage is not able to provide an accurate count of the bars in the picket fence and thus cannot provide an accurate position for the carriage. Moreover, at best, the positioning of the carriage is in a one-to-one ratio in that the resolution of the picket fence is dependent on a photosensor's ability to resolve the smallest dimension of the alternative bars of the picket fence.

Another known arrangement for positioning a printer carriage and print head is by providing an encoder disk attached (either directly or through gearing) to the carriage drive motor. The encoder disk has evenly spaced rectangular openings positioned around its periphery. A light source is placed on one side of the encoder disk and a photosensor is placed on the other side of the encoder disk. The photosensor detects the openings in the disk, and the printer's logic circuit converts the photosensor signal into a count. The resultant count is proportional to the rotational displacement of the encoder disk, which is in turn proportional to the rotational displacement of the carriage drive motor. The carriage is connected to the drive motor by means of the continuous, looped cable or belt transmission system so that the carriage's horizontal position is theoretically proportional to the rotational displacement of the drive motor and the encoder disk. Thus by monitoring the encoder disk's rotation, the printer's control logic knows where the carriage is located.

The encoder disk attached to the motor, can provide for a resolution ratio greater than one-to-one by means of providing a gearing between the motor drive and the encoder disk. In that regard, the encoder disk mounted on the carriage drive motor has an advantage over the picket fence arrangement.

The principal drawback to the encoder disk mounted on the motor drive is that between the encoder disk mounted near the drive motor and the carriage itself is a mechanical drive train consisting of the continuous looped cable or belt extending across the full width of the printer frame. As a result any stretching or backlash in that drive cable or any eccentricities in the pulleys on which the drive cable is mounted or any varying diameters in the drive pulleys all represent errors which can affect the accurate positioning of the carriage and print head.

For example, the backlash in the cable is particularly troublesome because the stretching and contraction of the cable relates to the inertia and speed of the movement of the carriage itself. As a result, during a continuous printing operation across a page, the carriage may be accurately positioned horizontally, whereas when the carriage is moved across a page in a long travel followed by a short burst of printing followed by another long travel, the backlash can significantly change the positioning of the print head for a given encoder disk rotational displacement.

Another conventional carriage control scheme is a so-called time-controlled system which utilizes a timer in conjunction with a stepping motor to establish the print head's horizontal position.

SUMMARY OF THE INVENTION

The present invention overcomes the disadvantages of the prior carriage control arrangements, particularly the picket fence arrangement and the encoder disk mounted on the drive motor.

Thus it is an object of the present invention to provide a carriage control apparatus, in which the accuracy of the horizontal positioning of the carriage is unaffected by variations in the carriage drive train as the carriage is driven back and forth on guide rails.

It is a further important object of the present invention to provide a carriage control apparatus that utilizes an encoder disk having spaced peripheral openings and associated photosensors mounted on the carriage itself and rotated by separate disk driving means in a fixed relationship to the carriage's position to minimize the effects of the carriage drive train.

It is also an object of the present invention to provide a carriage control apparatus having an encoder disk mounted on the carriage and driven by a disk driving means that provides a high degree of resolution of the carriage's position as a result of the fixed relationship between the disk's rotation and the carriage's position.

It is a collateral object of the present invention to provide a carriage control apparatus that provides a mask adjacent the encoder disk to act as a shutter and to thus assure accurate detection of the encoder disk's spaced openings by the photosensors.

A closely related object of the present invention is to provide a carriage control apparatus that can be sealed so that its performance is unaffected by dust and dirt.

It is a further object of the present invention to provide a carriage control apparatus that uses a serpentine, stationary timing belt having its ends attached to opposite sides of the printer frame and wrapped about an idler pulley and an encoder disk pulley to drive the encoder disk.

Collaterally it is an object of the present invention to provide a carriage control apparatus in which the carriage is mounted on parallel rails for horizontal movement and the timing belt is mounted to the frame in an offset fashion so that it exerts a side torque on the carriage to bias the carriage on its parallel mounting rails.

Other objects and advantages of the invention will become apparent upon reading the following detailed description and upon reference to the drawing.

DETAILED DESCRIPTION OF THE INVENTION

Figure 1:
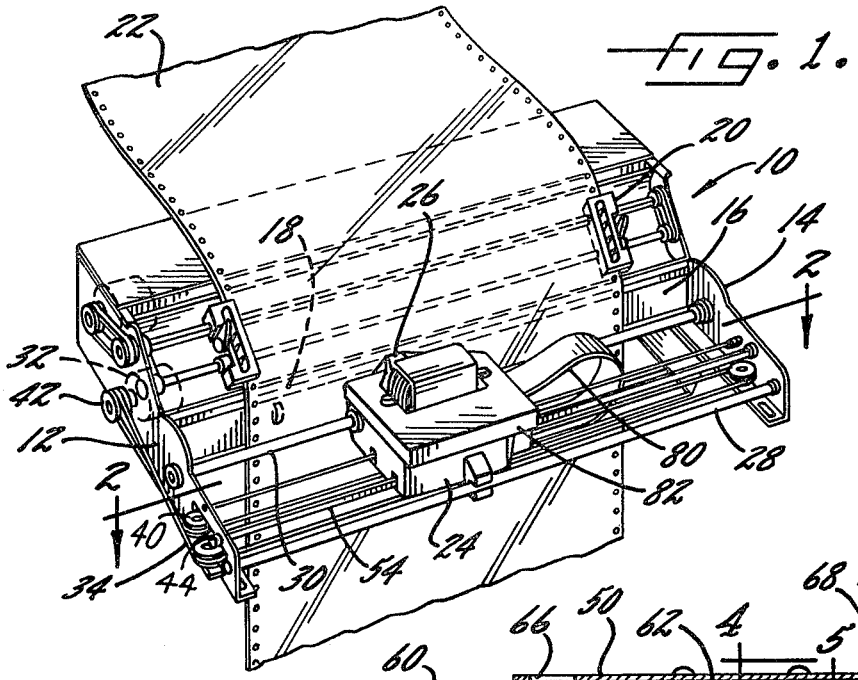
FIG. 1 is a perspective view of a computer printer (with the cover removed) which incorporates the present invention.

Turning to FIG. 1, there is shown a computer printer 10 for which the present invention is particularly useful. The printer 10 includes side frame members 12 and 14 having a platen 16 mounted therebetween and forming a structural, horizontal "backbone" for the printer. The platen 16 is provided with a paper backing surface 18 which extends horizontally across the length of the platen 16.

A paper tractor mechanism 20 is mounted between the side frame members 12, 14 to engage a continuous sheet of paper 22 and pull it incrementally (line by line) from a supply (not shown) across the paper backing surface 18 of the platen 16 as each successive line of printed characters is completed.

In order to print characters on the paper 22, a printer carriage 24 having a print head 26 is mounted for horizontal movement on parallel guide rails 28 and 30 so that the print head 26 is in line with the paper backing surface 18 of the platen 16 as the carriage 24 moves back and forth across the width of the printer 10 on the guide rails 28, 30. Also mounted on the carriage 24 is an ink ribbon cassette 27 containing an inked ribbon 27' and ribbon feed mechanism 27'', which is disclosed in greater detail in copending application Ser. No. 311,947, filed Oct. 16, 1981. The carriage 24 is driven back and forth across the width of the printer 10 by means of horizontal drive motor 32 and drive cable 34.

Figure 2:
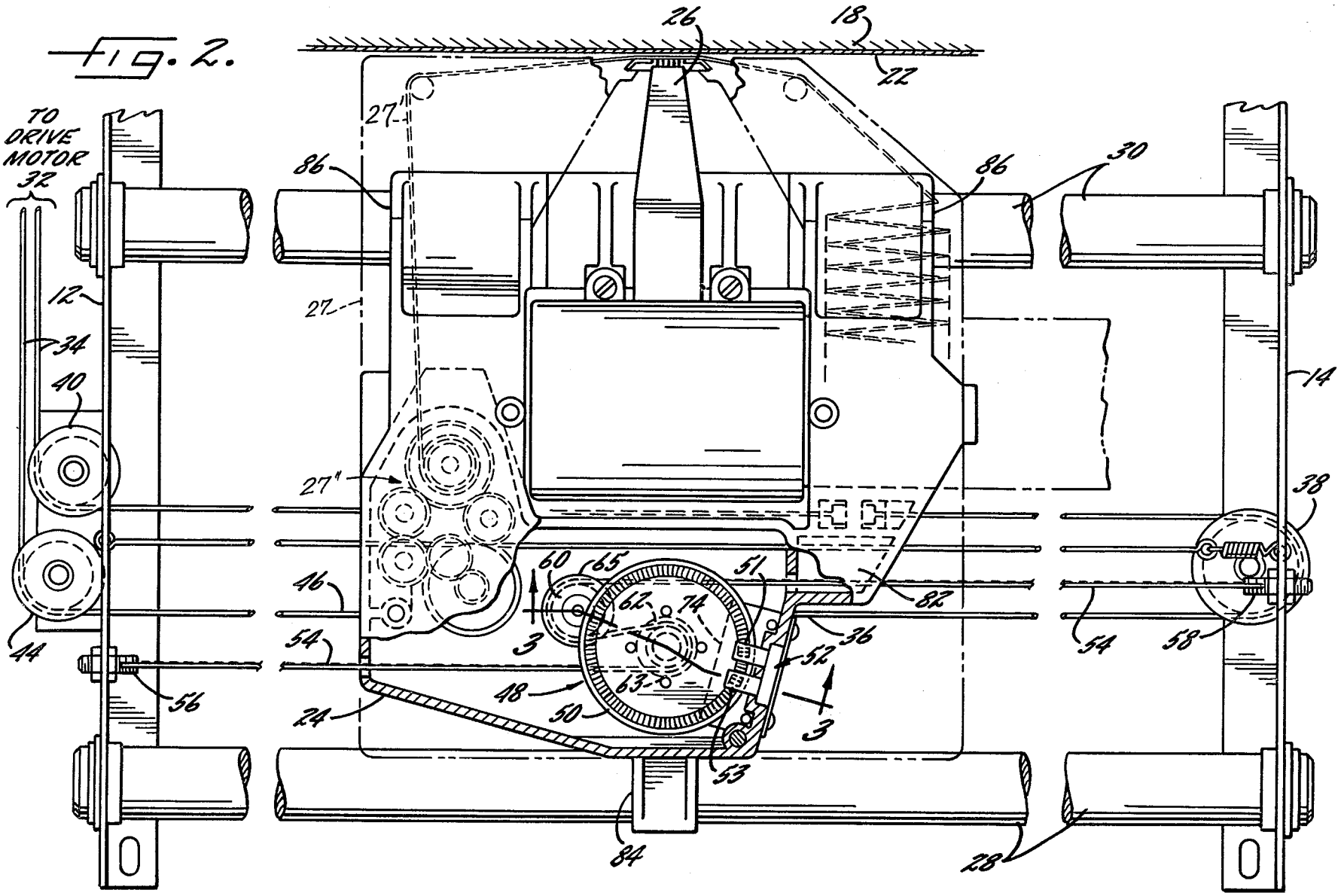
FIG. 2 is a sectional view of the carriage control apparatus of the present invention as viewed along line 2—2 in FIG. 1.

The details of the drive cable 34 are best understood with reference to FIG. 2. The drive cable 34 has one end 36 attached to the right hand side of the carriage 24. From end 36 the cable 34 is looped around idler pulley 38 mounted on right side frame member 14 and returns to idler pulley 40 mounted on the left side frame member 12. From pulley 40 the cable 34 extends to and around drive pulley 42 on drive motor 32 (FIG. 1) and back to idler pulley 44. From idler pulley 44, the other end 46 of cable 34 is attached to the left side of the carriage 24. Thus when the drive motor 32 rotates forward, the carrige 24 is driven in one horizontal direction; and when the drive motor 32 is reversed, the carriage 24 is driven in the opposite horizontal direction. The drive motor 32 is operated by conventional logic control circuitry 45 to move the carriage 24 and print head 26 along the line being printed.

In order to position accurately the carriage 24 along its horizontal travel, it is necessary for the logic control circuitry 45 to "know" where the carriage 24 is located along its horizontal path of travel. To that end, there is mounted on the carriage 24 a carriage control apparatus 48 (FIG. 2). The carriage control apparatus 48 comprises an encoder disk 50 mounted for rotation on the carriage 24, a rotational position sensing means 52 positioned adjacent the periphery of the encoder disk 50 to detect the rotational displacement of the encoder disk 50, and a serpentine toothed belt 54 that is attached at its ends 56 and 58 to the side frame members 12 and 14 respectively and is looped about idler pulley 60 and the encoder disk's geared sprocket wheel 62 to rotate the encoder disk 50.

Figure 3:
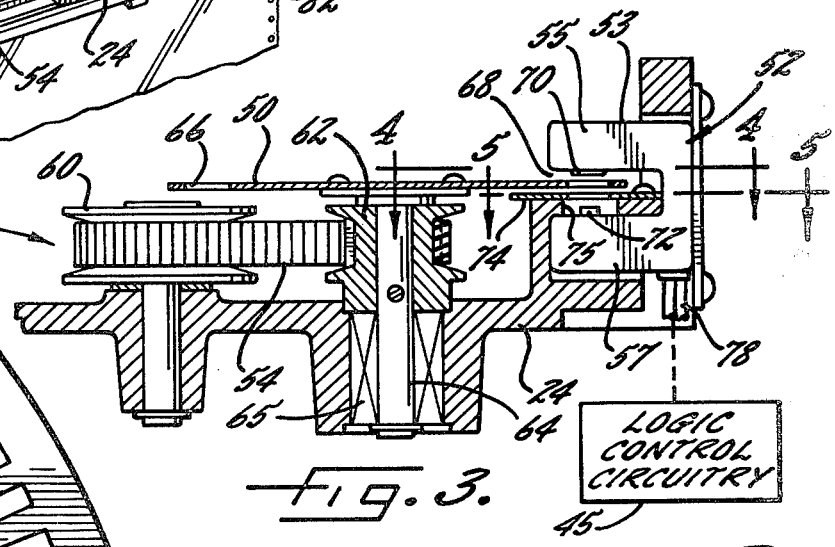
FIG. 3 is a detailed sectional view of the carriage and encoder disk to show detail of the photosensors as seen along line 3—3 in FIG. 2.

As can best be seen in FIG. 3, the encoder disk 50 is fixed to shaft 64 which is journalled via ball bearings, indicated at 65, in the carriage 24. The geared sprocket wheel 62 is fixed to, and rotates with, the encoder disk 50.

The serpentine toothed belt 54 is threaded as shown in FIG. 2. Beginning with its fixed end 56, the toothed belt 54 wraps around, and its teeth positively engage (greater than 180° of engagement), the geared sprocket wheel 62. The toothed belt 54 then wraps around idler pulley 60 and extends toward frame member 14 where it is attached at its other end 58. As the carriage 24 is driven to the right (FIG. 2) by motor 32 driving the cable 34, the toothed belt 54 engages sprocket wheel 62 and causes the encoder disk 50 to rotate clockwise. Likewise when the carriage 24 moves left the encoder disk 50 rotates counterclockwise. Because the toothed belt 54 has a low coefficient of elasticity, and because the number of teeth in the belt 54 and on geared sprocket wheel 62 are fixed, the horizontal position of the carriage 24 possesses a fixed relationship to the rotational position of the encoder disk 50. Put another way—if the rotational position of the encoder disk 50 is known, the horizontal position of the carriage 24 can be resolved.

Figure 4:
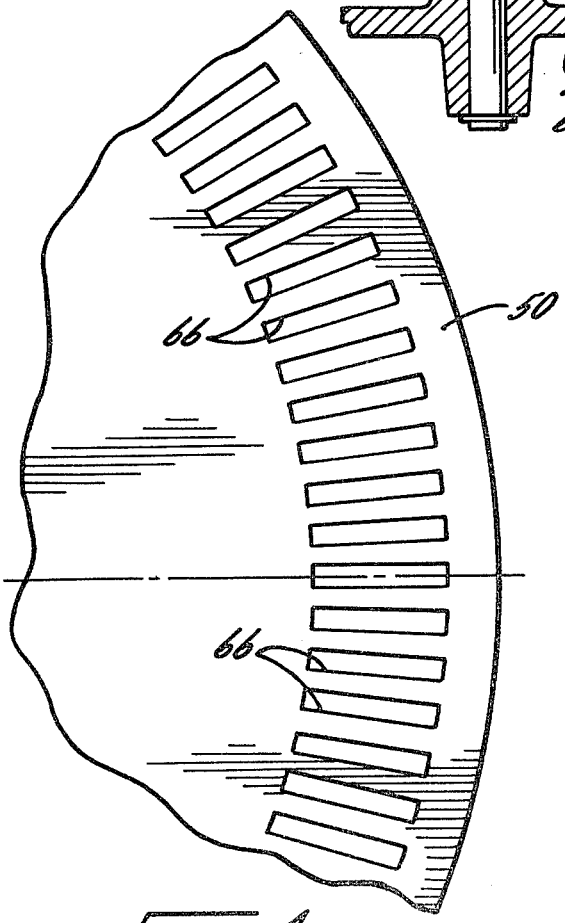
FIG. 4 is a detailed, fragmented section view of the encoder disk's periphery as seen along line 4—4 in FIG. 3.

The rotational position of the encoding disk 50 is detected by the sensing means 52. To that end, the encoder disk 50 has around its periphery evenly spaced rectangular openings 66 as shown in detail in FIG. 4.

Referring to FIG. 2, it can be seen that the periphery of the encoder disk 50 passes through the position sensing means 52. The sensing means 52 has two identical sensing stations 51 and 53 (FIG. 2) spaced along the circumference of the encoder disk 50. Referring to FIG. 3, the sensing station 53 consists of a U-shaped member having an upper arm 55 and a lower arm 57 which together define a slot 68. (Sensing station 51 is similarly constructed, and the following description and reference numerals will refer to both sensing stations.) A photo sensor 70 is mounted on the upper arm 55 within slot 68, and an aligned light source 72 is mounted on the lower arm 57. The light source 72 is contained within a cavity 75, and the cavity 75 is covered by a mask 74 which is thus disposed between the periphery of encoder disk 50 and the light source 72.

Figure 5:
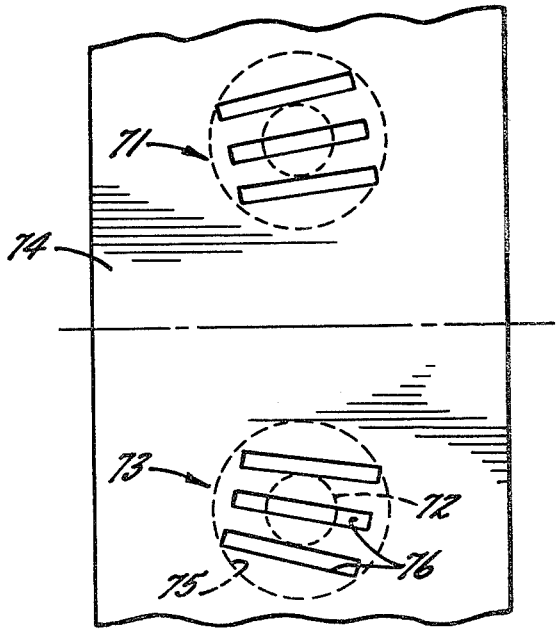
FIG. 5 is a detailed, fragmented section view of the shutter-like mask as seen along line 5—5 in FIG. 3.

The mask 74, shown in detail in FIG. 5, has two groups (71 and 73) of three spaced rectangular openings 76. Each group 71 and 73 aligns with one of the sensing stations 51 and 53 respectively. The three rectangular openings 76 within each group 71 and 73 have the same spacing as the openings 66 in the encoder disk 50, and each group (71 and 73) is vertically aligned respectively with the light source 72 and the photo sensor 70 at each sensing station 51, 53.

As the openings 66 and encoder disk 50 pass by the sensing stations 51, 53 of the sensing means 52, the openings 66 alternately block and transmit the light from light sources 72 to photo sensors 70. Thus the photo sensors 70 "see" a train of evenly spaced light pulses. The mask 74 provides a shutter effect to assure precise blocking and transmitting of the light to the photo sensor 70 and thus assures accurate detection of the light pulses passing through the openings 66 in the encoder disk 50 as the openings 66 pass by the photo sensors 70.

The photo sensors 70 convert the train of light pulses to a train of electrical pulses which are fed to the logic control circuitry 45 through wires 78 (FIG. 3 ) which become part of ribbon cable 80 (FIG. 1). The logic control circuitry 45 counts the electric pulses in conventional manner to determine the rotational position of the encoder disk 50 and thus monitor continuously the horizontal position of the carriage 24. The logic control circuitry 45 then can in conventional fashion activate and deactivate drive motor 32 to position accurately the carriage 24.

It should be noted that the resolution of the carriage's position in no way depends on the relationship of the drive train (cable 34 and its associated pulleys 38, 40 and 44). The resolution of the carriage's position is determined solely by the fixed relationship between the encoder disk 50 and toothed belt 54.

To insure continuing accurate operation of the carriage control apparatus the encoder disk 50 and the sensing means 52 are enclosed within the carriage 24 by a cover 82 (shown in FIG. 2, partially broken away). As a result, the carriage control apparatus of the present invention is sealed within the housing formed by carriage 24 and cover 82, and thus is not susceptible to the paper dust that is present near the platen 16 as the paper 22 is impacted by the print head 26 and advanced by the paper tractor mechanism 20 at high speed.

Also accurate positioning of the carriage 24 is further enhanced by the fact that the toothed belt 54 exerts a torque on the carriage 24. The torque results from the tension in the toothed belt 54 and the offset between the belt's engagement of sprocket wheel 62 at point 63 and its engagement of the idler pulley 60 at point 65. The resulting torque on the carriage 24 is clockwise (FIG. 2) which biases the carriage 24 against its parallel guide rails 28 and 30. Therefore, any tolerance in the bearing surfaces 84, 86 of the carriage 24 that engage the guides rails 28, 30 is minimized by assuring the carriage 24 maintains a constant orientation between the guide rails 28, 30.

We claim:

1. In a computer printer for serially printing a line of printed characters having a carriage with a print head thereon, the carriage arranged on guide rails that extend parallel to the line of characters and between frame members of the printer and having a drive motor, controlled by a logic control circuit, for driving the carriage back and forth between the frame members of the printer, a carriage control apparatus comprising (a) an encoder disk mounted for rotation on the carriage and having a coded pattern on its periphery;

(b) sensing means for detecting the coded pattern and transmitting the pattern to the logic control circuit; and (c) encoder disk drive means interconnecting the encoder disk and the frame members in a fixed relationship so that the rotational displacement of the encoder disk bears a fixed relationship to the position of the carriage along the line of printed characters.

2. The carriage control apparatus of claim 1 wherein the coded pattern on the encoder disk's periphery is a series of spaced openings and wherein the sensing means comprises a light source and a photo sensor aligned with the spaced openings on the encoder disk's periphery and a mask with spaced openings interposed between, and aligned with, the light source and the photo sensor to create a shutter effect.

3. The carriage control apparatus of claim 2 wherein the carriage includes a sealed housing and the encoder disk and sensing means are enclosed within the sealed housing.

4. The carriage control apparatus of claim 1 wherein the encoder disk drive means comprises a belt attached at each end to the frame members of the printer and engaging a sprocket wheel attached to the encoder disk to rotate the encoder disk in a fixed relationship to the position of the carriage.

5. The carriage control apparatus of claim 4 wherein the encoder disk drive means further includes an idler pulley mounted on the carriage and offset from the encoder disk and wherein the belt engages the sprocket wheel and idler pulley in offset fashion to create a torque on the carriage to orient the carriage between the guide rails.

6. In a computer printer for serially printing a line of printed characters having a carriage with a print head thereon, the carriage arranged on guide rails that extend parallel to the line of characters and between frame members of the printer and having a drive motor, controlled by a logic control circuit, for driving the carriage back and forth between the frame members of the printer, a carriage control apparatus comprising (a) an encoder disk mounted for rotation on the carriage and having a series of spaced openings around its periphery;

(b) sensing means including a light source and a photo sensor for converting light signals to electrical signals, aligned with the space openings on the encoder disk's periphery and having a mask with spaced openings interposed between, and aligned with, the light source and the photo sensor to create a shutter effect, the sensing means, thus configured, operating to detect light signals generated by the spaced openings during the encoder disk's rotation and to transmit resulting electrical signals to the logic control circuit; and (c) encoder disk drive means including a toothed belt attached to each end to the frame members of the printer and engaging a tooth engaging wheel attached to the encoder disk to rotate the encoder disk in a fixed relationship to the position of the carriage.

7. The carriage control apparatus of claim 6 wherein the carriage includes a sealed housing and the encoder disk and sensing means are enclosed within the sealed housing.

8. A carriage control apparatus of claim 6 wherein the encoder disk drive means further includes an idler pulley mounted on the carriage and offset from the encoder disk and wherein the belt engages the tooth engaging wheel and idler pulley in offset fashion to create a torque on the carriage to orient the carriage between the guide rails.

* * * * *